US006120649A

United States Patent [19]

Eriksson

[11] Patent Number: 6,120,649

[45] Date of Patent: Sep. 19, 2000

[54] BLADE HOLDER

[75] Inventor: Tore Eriksson, Klässbol, Sweden

[73] Assignee: BTG Källe Inventing AB, Säffle, Sweden

[21] Appl. No.: 09/091,523

[22] PCT Filed: Dec. 10, 1996

[86] PCT No.: PCT/SE96/01630

§ 371 Date: Jun. 19, 1998

§ 102(e) Date: Jun. 19, 1998

[87] PCT Pub. No.: WO97/25475

PCT Pub. Date: Jul. 17, 1997

[30] Foreign Application Priority Data

Jan. 9, 1996 [SE] Sweden ..... 9600077

[51] Int. Cl.[7] ..... D21G 3/00

[52] U.S. Cl. ..... 162/281; 15/256.51

[58] Field of Search ..... 162/280, 281; 15/256.51; 118/261, 413

[56] References Cited

U.S. PATENT DOCUMENTS 4,665,859 5/1987 Dunlap et al. ..... 15/256.51
4,906,335 3/1990 Goodnow et al. ..... 162/281
5,078,835 1/1992 Schiel et al. ..... 162/352
5,230,775 7/1993 Goodnow et al. ..... 162/281
5,328,570 7/1994 Wolf et al. ..... 162/352
5,738,726 4/1998 Kaipf et al. ..... 15/256.51
5,868,841 2/1999 Halmschlager ..... 162/281

*Primary Examiner*—Karen M. Hastings
*Attorney, Agent, or Firm*—Burns, Doane, Swecker & Mathis, L.L.P.

[57] ABSTRACT

Blade holder for creping of a web travelling on a rotating cylinder (2) or for doctoring the surface of the cylinder, comprising a blade (3) directed opposite to the travelling direction of the cylinder (2), a blade carrier (41) for the blade, further comprising a pressure ledge (13) extending along the whole length of the blade and arranged to exert a pressure at or adjacent to the upper longitudinal edge of the blade (3) via pivotable pressure arms (15) evenly distributed along the length of the ledge and arranged on the blade carrier (41) to bring said edge to engagement against the cylinder (2). Each pressure arm (15) is arranged to be individually actuated by a pressure means having a double folded membrane (35) for actuation of the pressure arm (15) by means of a pressure medium.

19 Claims, 4 Drawing Sheets

BLADE HOLDER

The present invention relates to a blade holder for creping of a web, particularly a paper web, travelling on a rotating cylinder, or for doctoring a rotating cylinder surface.

The development in the paper manufacture technology has resulted in demands for ever increasing production rates coupled to increasing web widths. Today plants are installed having paper speeds of up to 1500 m/min and with paper widths which in some cases are up to 8 m or more. Such plants require great precision with regard to blade suspension and possibility of section-wise individual adaptation of the engagement pressure of the blade across the whole width of the web. Furthermore, the high costs associated with even short standstill of a large machine require that machine maintenance in the form of for example blade replacement can be carried out quickly and effectively with a minimum of time waste. Furthermore, there is required for obtaining optimal function the possibility of adjusting the blade angle of attack in relation to the cylinder on which the paper web is fed in a simple manner.

The present invention has for its object to provide a blade holder device for creping of web travelling on a rotating cylinder or for doctoring a cylinder surface, said device meeting high demands in the respects as indicated above.

Accordingly, the invention has for a primary object to provide a blade holder for creping of a travelling web, particularly a paper web, wherein the engagement pressure of the blade on the cylinder carrying the travelling web can be adjusted along the whole length of the blade without changing the blade angle of attack against the cylinder surface.

Another object of the invention is to provide a blade holder enabling easy exchange of blade at a minimum of time.

Yet an object of the invention is to provide a blade holder by which the blade angle of attack against the cylinder carrying the travelling web can be varied in a simple manner without affecting other parameters.

Another object is to provide for a simple method of adjusting the blade holder for varying blade widths.

A further object is to provide possibility for section-wise individual adjustement of the engagement pressure of the blade against the cylinder.

For these and other objects which will be clear from the following description there is provided through the present invention a blade holder for creping of a web, particularly a paper web, travelling on a rotating cylinder, or for doctoring the surface of the cylinder, comprising a blade directed opposite to the travelling direction of the cylinder, a blade holder for the blade, further comprising a pressure ledge extending along the whole length of the blade and arranged to exert a pressure at or adjacent to the upper longitudinal edge of the blade via pivotable pressure arms evenly distributed along the length of the ledge and arranged on the blade holder to bring said edge to engagement against the cylinder. Said blade holder is characterized in that each pressure arm is arranged to be individually actuated by a pressure means having a double folded membrane for actuation of the pressure arm by means of a pressure medium.

According to a preferred embodiment of the blade holder according to the invention each pressure arm has associated therewith an individually adjustable counter-pressure means whereby the actuation of the blade by the pressure means can be balanced.

In a particularly preferred embodiment of the blade holder according to the invention the membrane is provided with a double folded annular member, said member comprising a central section surrounded by said member cooperating with a stop member fixed onto the blade holder, and a ring-shaped section surrounding the annular section, said ring-shaped section being leak-tight connected to a surrounding ring element, said membrane and a corresponding lid element together with the ring element defining a pressure chamber which, via an opening, can be pressurized to a desired pressure by means of a pressure medium, said pressure affecting the associated pressure arm via the ring element.

With regard to the blade holder and the attachment of the blade to the holder it is preferred that the blade holder comprises a blade carrier ledge provided with a groove or recess extending along the whole length of the blade carrier ledge and having a depth short of the width of the blade and widening outwardly so that the blade with its lower longitudinal edge contained in the groove or recess in the absence of exterior influence can tilt and move freely towards or away from the cylinder.

It is, moreover, preferred that the blade holder comprises a carrier beam carrying guide ledges extending along the whole length of the blade and between which the blade can be displaced upwardly towards the cylinder synchronously with the wear of the blade.

Furthermore, the carrier beam suitably carries jackscrews whereby the blade carrier ledge is continuously displacable towards the cylinder in accordance with the wear of the blade.

In this context it is particularly preferred that each jackscrew is provided with an adjustment nob with a scale which is graduated in such a manner as to show the distance between the point of engagement of the blade against the cylinder and the bottom of the recess of the blade carrier ledge thus giving a measure of the width of the blade.

In a preferred embodiment of the blade holder according to the invention the press ledge is arranged to exert its pressure adjacent to the longitudinal edge of the blade engaging the cylinder so as to impart no essential bending of the blade. In order to obtain such condition it is suitable that the pressure of the press ledge against the blade is exerted along a line at a distance of less than about 15 mm and preferably 3–8 mm from the point of contact of the blade with the cylinder.

In yet another preferred embodiment of the blade holder according to the invention it comprises suspension arms for the carrier beam arranged at each end of the blade holder each provided with two legs and attached to the carrier beam at the ends thereof, one leg being pivotably connected to a fixed element, whereas the other leg via a first position adjustment means can be raised or lowered for controlling the blade angle in relation to a tangent to the surface of the cylinder, and the pivot center (C) being positioned in the point of attachment between the blade and the cylinder. By this arrangement the attack angle of the blade can thus be varied without changing other conditions.

For the purpose of enabling maintenance, for example exchange of blade, it is preferred that the blade holder according to the invention comprises a rocking means, whereby the blade with the carrier beam can be moved between an operating position and an inoperative position, said rocking means comprising link arms arranged at each end of the carrier beam which at one end thereof are pivotably connected and one link arm at the opposite end thereof is pivotably connected to a pivot arm which is fixed to the rotary shaft of the carrier beam and the opposite end of the other link arm is pivotably connected to the suspension arm, a second position adjustment means being arranged on the latter arm capable of moving the pivotable point of attachment of the link arms to a rectilinear operative position or an angular inoperative position.

In a particularly preferred embodiment of this device the second position adjustment means is pivotably connected to the suspension arm and is constituted by a hydraulic or pneumatic cylinder having a piston and a piston bar at the free end of which said one end of the link arms is pivotably connected. Furthermore, the position adjustment means is suitably connected to the fixed element, whereas the opposite end of the second link arm preferably is connected to a first projection on the second leg.

BRIEF DESCRIPTION OF THE DRAWINGS

The invention will now be further illustrated in connection to a preferred embodiment and with reference to the appended drawings, wherein.

DETAILED DESCRIPTION OF THE DRAWINGS

Figure 1:
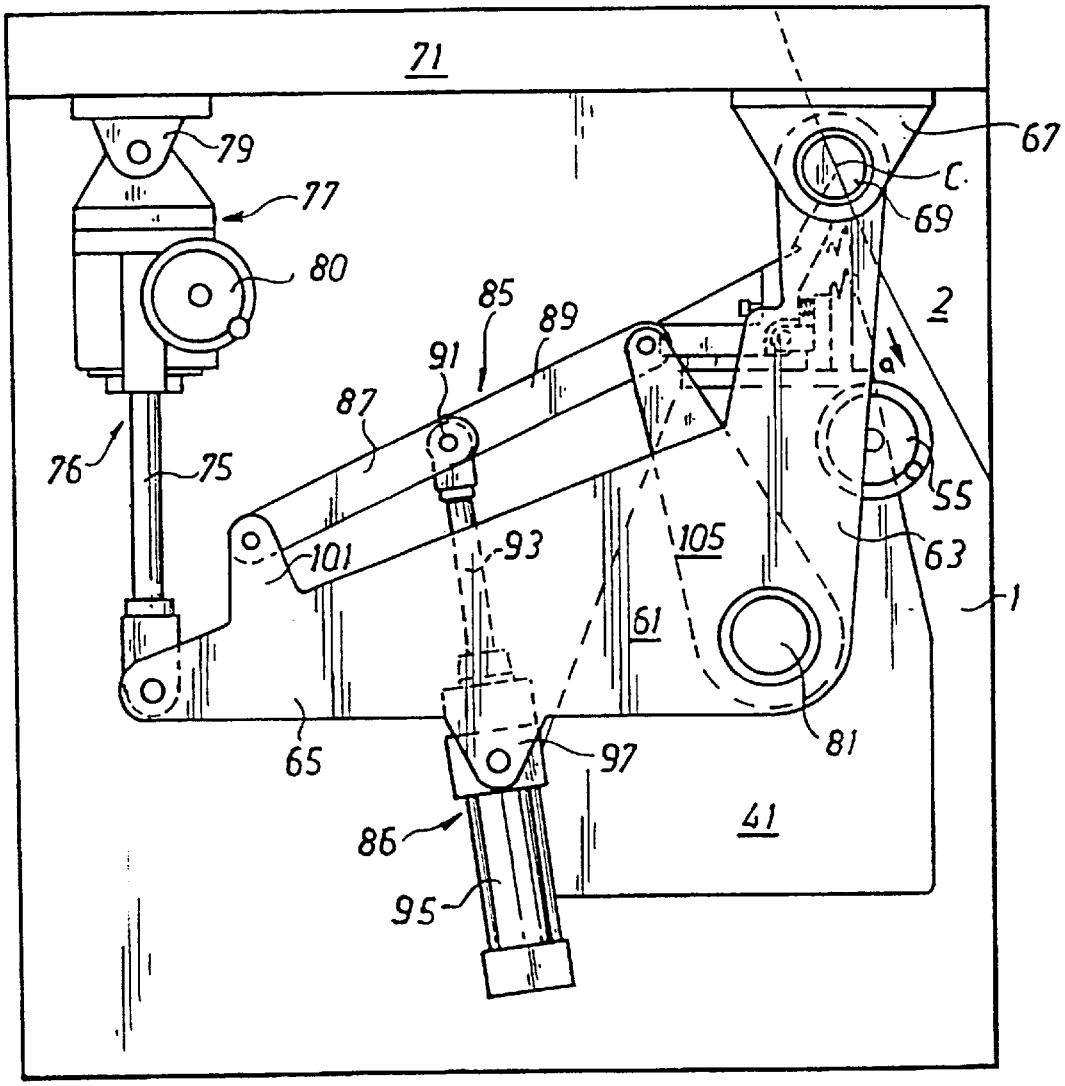
FIG. 1 is a sideview diagrammatically illustrating a blade holder in accordance with the invention.
Figure 2:
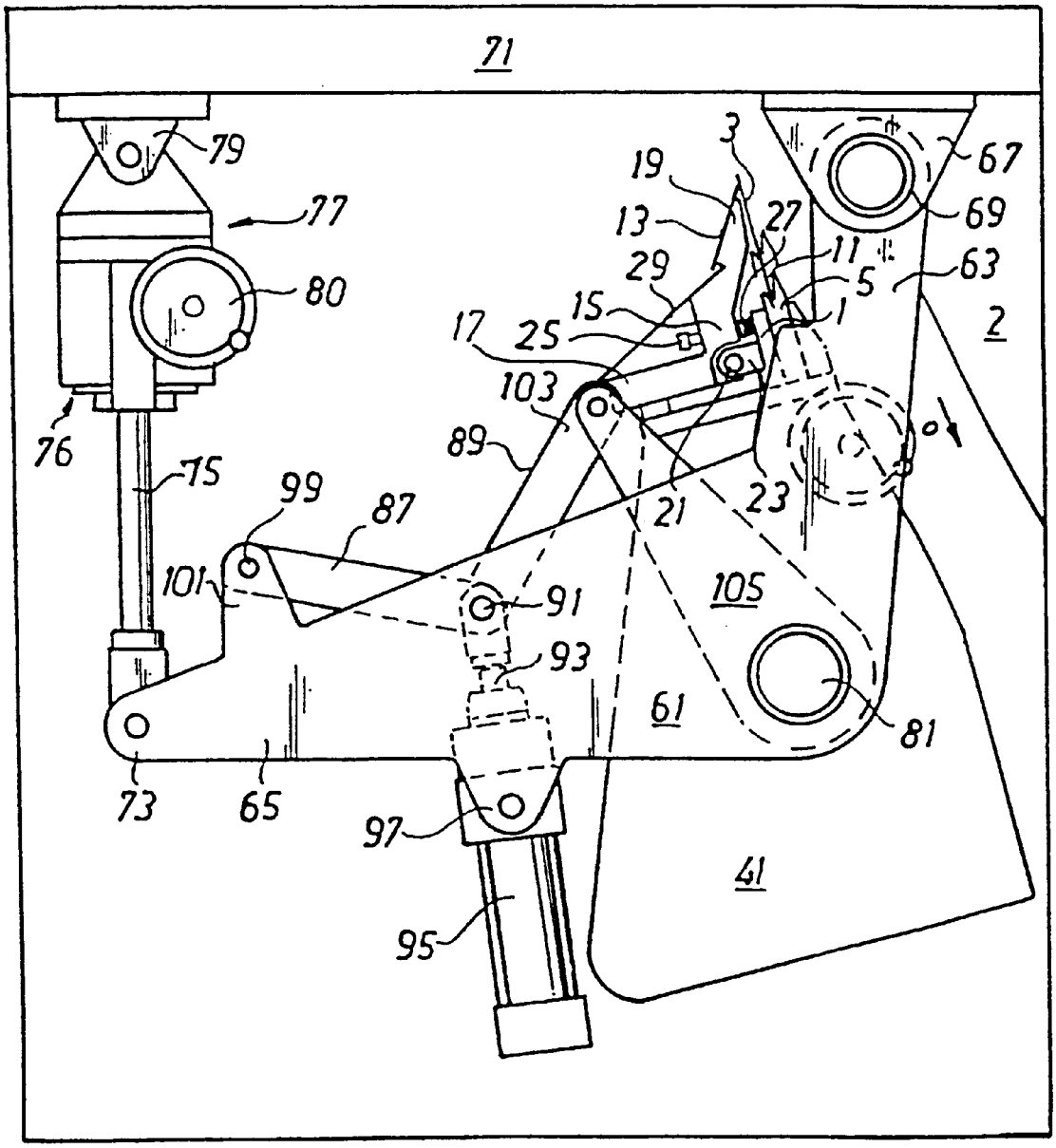
FIG. 2 shows said embodiment with the blade in an inoperative position.

With particular reference to FIGS. 1 and 2 the embodiment of the blade holder according to the invention illustrated in the drawings comprises a blade carrier device generally designated 1 carrying a blade 3, for example intended for the creping of a paper web, said blade in turn resting on a blade carrier ledge 5, especially in a groove or recess 11 arranged at the upper part of said ledge. As is clear from for example FIG. 3 said recess 11 extends along the whole length of the blade carrier ledge 5 and has a depth substantially short of the width of the blade and widening upwardly in such a manner that blade 3 with its lower longitudinal edge contained in the recess in the absence of outer influence can tilt and move freely towards or away from a cylinder 2 on which the travelling web is carried.

The blade carrier ledge 5 is placed between two guide members 7,9 extending along the whole length of the blade carrier ledge and the blade.

Figure 4:
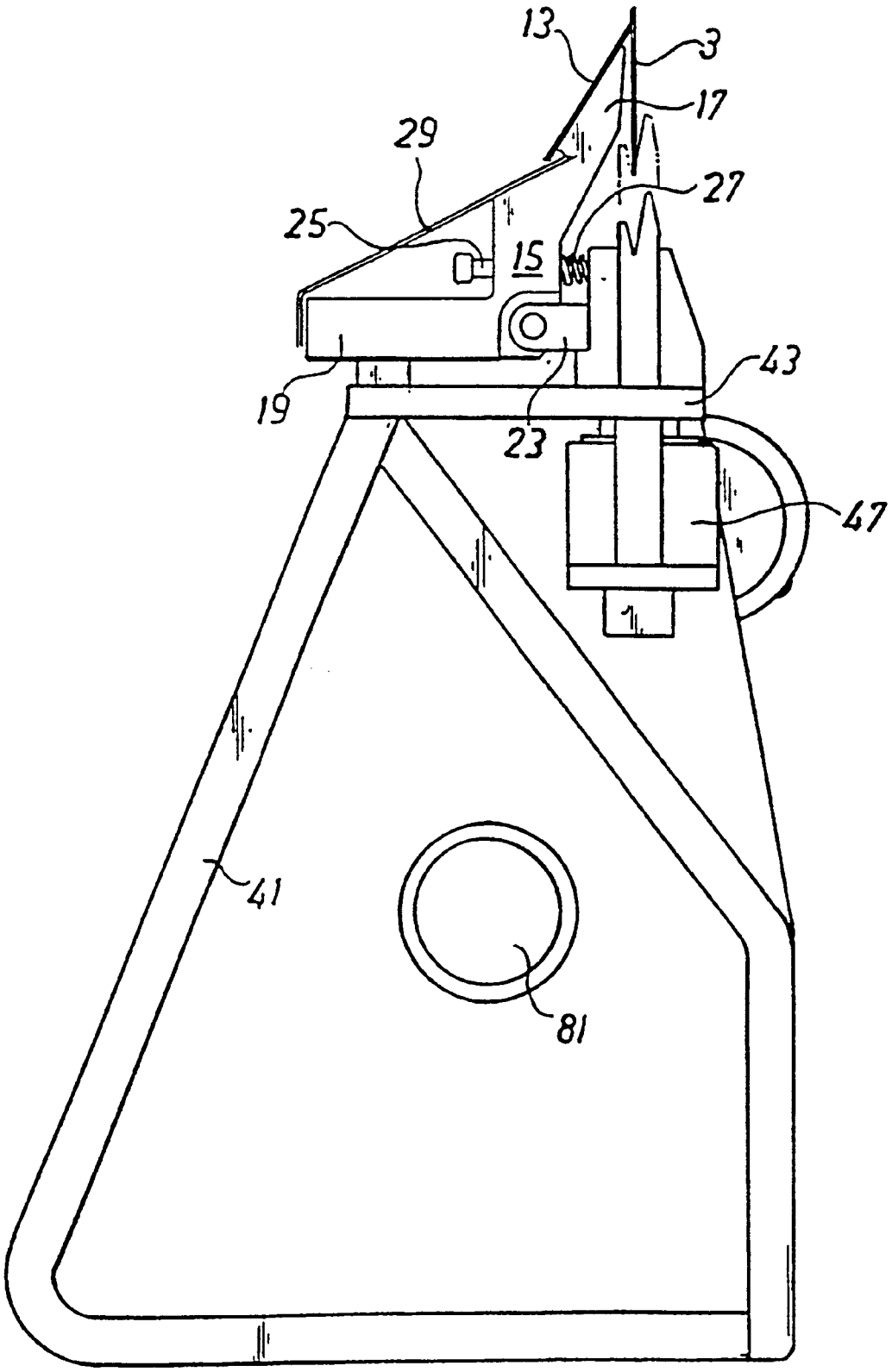
FIG. 4 shows a detail in enlargement of the blade carrier with carrier beam and operative means associated with the blade.

As is clear from FIG. 4 the supporting function of the blade carrier is provided by a beam profile 41 with an upper plate 43 arranged on top of said profile, the blade 3 and associated guide members 7,9 being placed on said plate.

Figure 3:
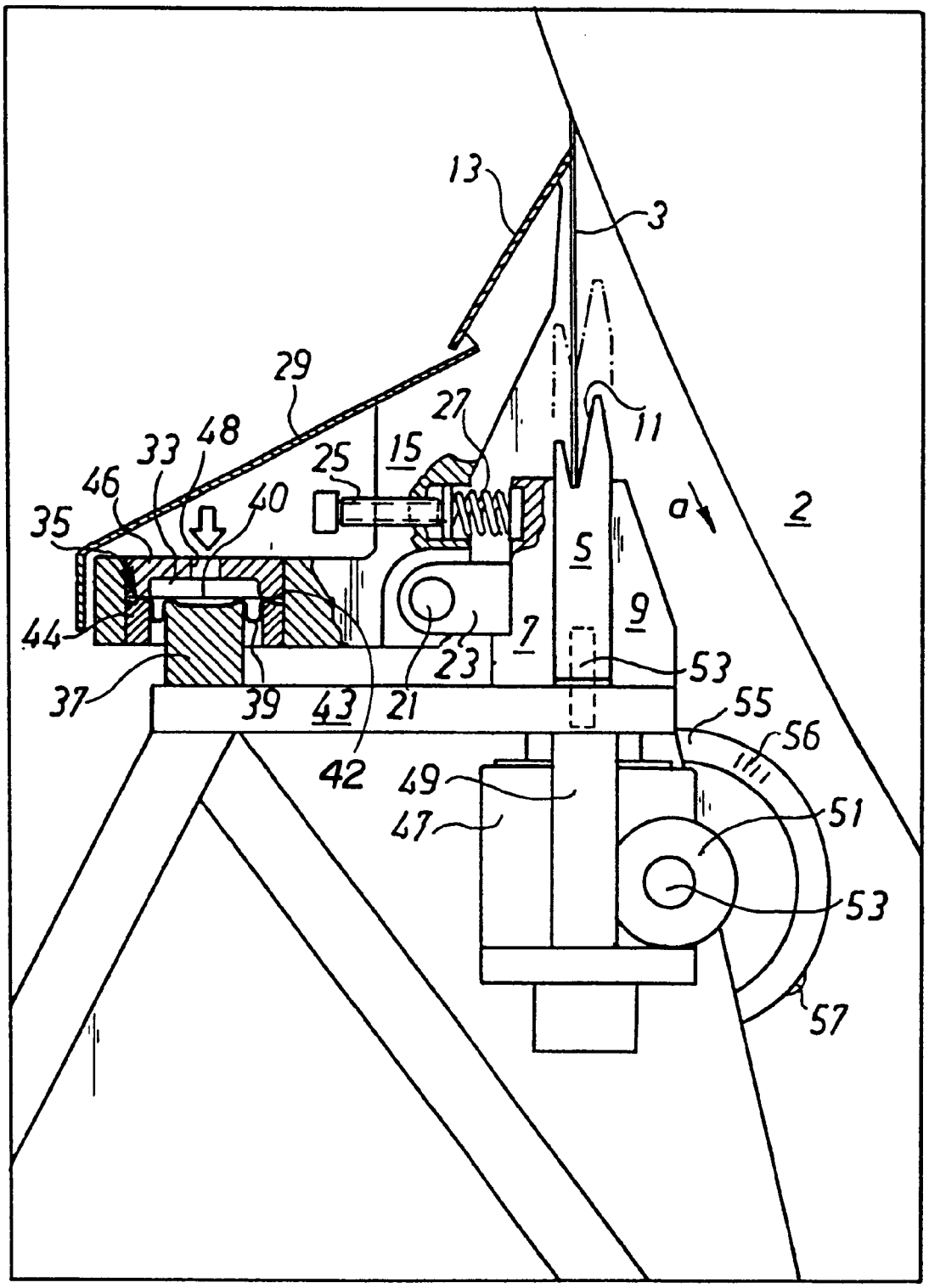
FIG. 3 shows more in detail and in an enlargement the arrangement around the blade carrier and the blade.

As is clear from FIG. 3 the blade carrier ledge 5 can be moved upwardly synchronously with the wear of the blade 3 by at least two adjustment devices generally designated 45 arranged at both ends of the blade carrier ledge 5. The adjustment device 45 includes a worm gear 47 with a screw 49 and a cooperating tooth wheel 51 rotatable around an axis 53 by means of a handle wheel 55 with a handle 57. The screw 49 is at its upper end provided with a threaded section 59 cooperating with a corresponding interior thread in the blade carrier ledge 5. The handle wheel 55 is provided with a graduated scale 56 which is graduated in such a manner that it shows the distance between the point C of engagement of the blade 3 against the cylinder 2 and the bottom of the recess 11 of the blade carrier ledge 5, said distance being equal to the width of the blade.

In order to provide the engagement of the blade 3 against the cylinder 2 the illustrated embodiment contains as is clear from FIG. 2 a press ledge 13 extending along the whole length of the blade 3. This press ledge 13 is carried by angle arms 15 which are pivotable around a pivot 21 and each comprise an upwardly directed part 17 and a horisontal part 19. The pivot 21 is anchored in a pivot attachment 23 in turn connected to the guide member 7. Each angle arm 15 can be selectively actuated by an upward force affecting the horisontal part 19 of the angle arm 15. This force actuation is provided by a device positioned in a recess 31 in the horisontal part 19 of each angle arm 15. This device is briefly designed in the following manner.

As is clear from FIG. 3 pressure actuation is provided by a double-folded membrane 35 comprising a double-folded annular section 39, a central section 40 surrounded by said annular section and cooperating with a fixed stop member 37 in the form of an upwardly directed cylinder arranged on the upper plate 43 on the carrier beam 41. Furthermore, the membrane includes a ring-shaped section 42 surrounding the annular section 39 and tightly connected to a surrounding ring element 44. Together with an opposite lid element 46 membrane 35 defines together with the ring element 44 a pressure chamber 33 which via an opening 48 in the lid element 46 can be pressurized to a desired pressure by means of a pressure medium. The pressurization of the pressure chamber 33 which can be provided by hydraulic or pneumatic means affects via the ring element 44 the corresponding angle arm 15 to press blade 3 via press ledge 13 against the cylinder 2. It is important to note that the pressure device just described provides an upward force on the horisontal part 19 of the angle arm 15 which is only determined by the pressure generated by the pressure medium irrespective of the position of the horisontal part 19 in relation to the fixed stop member 37. By using a double-folded membrane 35 every influence of the elasticity properties of the membrane material will thus be avoided and a movement of the horisontal part of angle arm 15 essentially free of friction will be provided.

As is further clear from FIG. 3 the blade holder device is provided with a counter pressure member 25 with associated spring 27, the pressure generated by the membrane device being counteracted to the desired degree. In this manner there is obtained a balanced engagement pressure of the blade via the pressure ledge 13 in view of the fact that the counterpressure by counterpressure member 25 can be controlled by presetting of the counterpressure member 25, for example by arranging member 25 with threads in the angle arm 15 thereby making same possible to preset. The devices just described are contained below a cover sheet 29 extending along the whole length of the carrier beam 41.

As is clear from FIG. 1 the carrier beam 41 is carried via its shafts 81 by suspension arms 61 arranged at each end of the blade holder. Each suspension arm 61 is provided with two legs, one upwardly directed leg 63 and one horisontal leg 65. The upwardly directed leg 63 is pivotably connected by a pivot 69 to an upper beam 71 via a pivot attachment 67 attached to the beam 71. The second leg can via a first position adjustment device generally designated 76 be lifted or lowered for a purpose to be described below. The position adjustment device 76 comprises two jackscrews 77 with handle wheels 80 coupled in parallel, said screws being pivotably arranged in a pivot attachment 79 connected to the upper beam 71. The screw 75 of jack 77 is pivotably connected to the horisontal leg 65 of the suspension arm 61 via a pivot 73.

As is clear from FIG. 1 the angle of attack of the blade against cylinder 2 can be varied by means of the position adjustment device 76, and this without changing the contact line and the contact pressure against cylinder 2. This is provided by the fact that the center for the swing movement, i.e. the center of pivot 69, coincides with the contact point C between blade 3 and cylinder 2.

As is clear from FIGS. 1 and 2 the embodiment of the blade holder according to the invention is provided with a swing device, whereby the blade 3 with the carrier beam 41 can be moved between an operating position (FIG. 1) and an inoperative position (FIG. 2) in order to enable some maintenance, for example exchange of blade. This swing device generally designated 85 comprises link arms 87,89 arranged at each end of the carrier beam 41, said link arms at one end thereof being pivotably connected to each other via a pivot 91. The opposite end of one link arm 89 is pivotably connected to a lever 105 which is fixed to the pivot or shaft 81 of the carrier beam, whereas the other end of the other link arm 87 is pivotably connected to the horisontal leg 65 of the suspension arm 61 via an extension 101 on said leg.

The swing device 85 further comprises a second position adjustment device generally designated 86. This second position adjustment device 86 comprises a hydraulic or pneumatic cylinder 95 with piston (not shown) and piston bar 93 at the free end of which the mutually connected ends of the link arms 87,89 are pivotably attached via a pivot 91. The hydraulic or pneumatic cylinder 95 is pivotably connected to the horisontal leg of the suspension arm 61 via a second extension 97.

While manoeuvring hydraulic or pneumatic cylinder 95 with withdrawal of piston bar 93 the blade holder can be adjusted to the position shown in FIG. 2, i.e. an inoperative position enabling for example exchange of blade. By extension of the piston bar 93 the blade 3 can be returned to an operative position according to FIG. 1, and this position can be exactly determined by bringing the link arms 87,89 to a rectilinear position according to FIG. 1. This position can be easily reached by the piston of cylinder 95 taking an end position where link arms 87,89 take the rectilinear position which is shown in FIG. 1.

The embodiment described provides for substantial advantages which briefly are the following.

By means of the arrangement around the pressing ledge 13 the blade can over its entire length be brought to engagement against the cylinder 2 section-wise and individually to obtain an even engagement and creping or doctoring effect over the whole length of the blade. This can be done with great accuracy by the use of the roll membrane 35 in combination with the counter member 25. Furthermore, by means of the adjustment device 45 the blade can be progressively lifted in pace with the wear and with simultaneous control of the remaining width of the blade.

By means of the first position adjustment device 76 the attack angle of the blade 3 against the cylinder 2 can be varied without changing the point of engagement and the engagement pressure of the blade against the cylinder will be changed.

Finally, by means of the second position adjustment device 86 the blade together with the carrier beam 41 can in a simple manner be moved to the inoperative position shown in FIG. 2, whereby for example exchange of blade easily can be carried out.

The blade holder according to the present invention thus offers improved flexibility under operation, a more even creping over the whole length of the blade, less waste of time in connection with maintenance, blade exchange etc., and simplified possibility of variation of the attack angle of the blade.

It should be observed that the present invention is not restricted to the embodiment described above and that its scope is limited only by the contents of the appended claims. The skilled artisan easily realizes how the device can be modified in different ways within the framework of the inventive concept.

What is claimed is:

1. Blade holder for creping of a web travelling on a rotating cylinder or for doctoring the surface of the cylinder, comprising a blade directed opposite to the travelling direction of the cylinder, a blade carrier for the blade, further comprising a pressure ledge extending along the whole length of the blade and arranged to exert a pressure at or adjacent to the upper longitudinal edge of the blade via pivotable pressure arms evenly distributed along the length of the ledge and arranged on the blade carrier to bring said edge to engagement against the cylinder, wherein each pressure arm is arranged to be individually actuated by a pressure means having a membrane for actuation of the pressure arm by means of a pressure medium, further comprising a blade carrier ledge provided with a groove or recess at the upper part thereof extending along the whole length of the blade carrier ledge and having a depth short of the width of the blade and widening outwardly so that the blade with its lower longitudinal edge contained in the groove or recess in the absence of exterior influence can tilt and move freely towards or away from the cylinder.

2. Blade holder according to claim 1, wherein each pressure arm has associated therewith an individually adjustable counter pressure means.

3. Blade holder according to claim 1, wherein the blade carrier comprises a carrier beam supporting guide ledges extending along the whole length of the blade and between which the blade can be displaced upwardly towards the cylinder synchronously with the wear of the blade.

4. Blade holder according to claim 3, wherein the carrier beam carries jackscrews coupled in parallel, whereby the blade carrier ledge is continuously displaceable towards the cylinder in accordance with the wear of the blade.

5. Blade holder according to claim 5, wherein each jackscrew is provided with an adjustment nob provided with a scale which is graduated in such a manner as to show the distance between the point of engagement of the blade against the cylinder and the bottom of the recess of the blade carrier ledge, equal to the width of the blade.

6. Blade holder according to claim 1, wherein the pressure ledge is arranged to exert its pressure so near to the longitudinal edge of the blade that no essential bending of the blade takes place.

7. Blade holder according to claim 1, comprising suspension arms for the carrier beam arranged at each end of the blade holder, each provided with two legs and attached to the carrier beam at the ends thereof, one leg being pivotably connected to a fixed element, whereas the other leg via a first position adjustment means can be raised and lowered for controlling the angle of the blade in relation to a tangent to the surface of the cylinder, and the pivot center being positioned in the point of attachment between the blade and the cylinder.

8. Blade holder according to claim 1, comprising a rocking means, whereby the blade with the carrier beams can be moved between an operating position and an inoperative position so as to enable maintenance, said rocking means comprising link arms arranged at each end of the carrier beam which at one end thereof are pivotably connected to a pivot arm which is fixed to the rotary shaft o the carrier beam, and the opposite end of the other link arm being pivotably connected to the suspension arm, a second position adjustment means being arranged which can move the pivotable point of attachment of the link arms to a rectilinear operative position of an angular inoperative position.

9. Blade holder according to claim 8, wherein the second position adjustment means is pivotably connected to the suspension arm and is constituted by a hydraulic or pneumatic cylinder having a piston and a piston bar at the free end of which said one end of the link arms is pivotably connected.

10. Blade holder according to claim 7, wherein the position adjustment means is connected to the fixed element.

11. Blade holder according to claim 8, wherein the opposite end of the second link arm is attached to a first extension on the second leg.

12. Blade holder according to claim 9, wherein the cylinder is pivotably connected to a second extension on the second leg.

13. Blade holder according to claim 2, wherein the pressure ledge is arranged to exert its pressure so near to the longitudinal edge of the blade that no essential bending of the blade takes place.

14. Blade holder according to claim 2, comprising suspension arms for the carrier beam arranged at each end of the blade holder, each provided with two legs and attached to the carrier beam at the ends thereof, one leg being pivotably connected to a fixed element, whereas the other leg via a first position adjustment means can be raised or lowered for controlling the angle of the blade in relation to a tangent to the surface of the cylinder, and the pivot center being positioned in the point of attachment between the blade and the cylinder.

15. Blade holder according to claim 19, wherein the opposite end of the second link arm is attached to a first extension on the second leg.

16. Blade holder according to claim 10, wherein the cylinder is pivotably connected to a second extension on the second leg.

17. Blade holder for creping of a web travelling on a rotating cylinder or for doctoring the surface of the cylinder, comprising a blade directed opposite to the travelling direction of the cylinder, a blade carrier for the blade, further comprising a pressure ledge extending along the whole length of the blade and arranged to exert a pressure at or adjacent to the upper longitudinal edge of the blade via pivotable pressure arms evenly distributed along the length of the ledge and arranged on the blade carrier to bring said edge to engagement against the cylinder, wherein each pressure arm is arranged to be individually actuated by a pressure means having a membrane for actuation of the pressure arm by means of a pressure medium, wherein the membrane is provided with a double folded annular member, a central section surrounded by said member and cooperating with a stop member fixed onto the blade carrier, and a ring-shaped section surrounding the annular section which is leak-tight connected to a surrounding ring element, said membrane and an opposite lid element together with the ring element defining a pressure chamber which, via an opening, can be pressurized to a desired pressure by means of a pressure medium, said pressure affecting the associated pressure arm via the ring element.

18. Blade holder for creping of a web travelling on a rotating cylinder or for doctoring the surface of the cylinder, comprising a blade directed opposite to the travelling direction of the cylinder, a blade carrier for the blade, further comprising a pressure ledge extending along the whole length of the blade and arranged to exert a pressure at or adjacent to the upper longitudinal edge of the blade via pivotable pressure arms evenly distributed along the length of the ledge and arranged on the blade carrier to bring said edge to engagement against the cylinder, wherein each pressure arm is arranged to be individually actuated by a pressure means having a membrane for actuation of the pressure arm by means of a pressure medium, wherein each pressure arm has associated therewith an individually adjustable counter pressure means, and wherein the membrane is provided with a double folded annular member, a central section surrounded by said member and cooperating with a stop member fixed onto the blade carrier, and a ring-shaped section surrounding the annular section which is leak-tight connected to a surrounding ring element, said membrane and an opposite lid element together with the ring element defining a pressure chamber which, via an opening, can be pressurized to a desired pressure by means of a pressure medium, said pressure affecting the associated pressure arm via the ring element.

19. Blade holder for creping of a web travelling on a rotating cylinder or for doctoring the surface of the cylinder, comprising a blade directed opposite to the travelling direction of the cylinder, a blade carrier for the blade, further comprising a pressure ledge extending along the whole length of the blade and arranged to exert a pressure at or adjacent to the upper longitudinal edge of the blade via pivotable pressure arms evenly distributed along the length of the ledge and arranged on the blade carrier to bring said edge to engagement against the cylinder, wherein each pressure arm is arranged to be individually actuated by a pressure means having a membrane for actuation of the pressure arm by means of a pressure medium, wherein each pressure arm has associated therewith an individually adjustable counter pressure means, and further comprising a blade carrier ledge provided with a groove or recess at the upper part thereof extending along the whole length of the blade carrier ledge and having a depth short of the width of the blade and widening outwardly so that the blade with its lower longitudinal edge contained in the groove or recess in the absence of exterior influence can tilt and move freely towards or away from the cylinder.

* * * * *